United States Patent [19]

Buck et al.

[11] Patent Number: 4,516,550

[45] Date of Patent: May 14, 1985

[54] ELECTRONIC CONTROL DEVICE FOR A FUEL METERING SYSTEM OF AN INTERNAL COMBUSTION ENGINE WITH SELF-IGNITION

[75] Inventors: Rainer Buck, Tamm; Thomas Küttner, Stuttgart; Fridolin Piwonka, Tamm; Wolf Wessel, Oberriexingen, all of Fed. Rep. of Germany

[73] Assignee: Robert Bosch GmbH, Stuttgart, Fed. Rep. of Germany

[21] Appl. No.: 606,555

[22] Filed: May 7, 1984

Related U.S. Application Data

[63] Continuation of Ser. No. 415,615, Sep. 3, 1982, abandoned.

[30] Foreign Application Priority Data

Mar. 16, 1982 [DE] Fed. Rep. of Germany ..... 3209433

[51] Int. Cl.[3] ..... F02D 31/00

[52] U.S. Cl. ..... 123/357; 123/340; 123/179 L

[58] Field of Search ..... 123/357–359, 123/340, 366, 179 L, 491

[56] References Cited

U.S. PATENT DOCUMENTS

| | | | |
|---|---|---|---|
| 4,193,380 | 3/1980 | Marchak et al. | 123/480 |
| 4,223,654 | 9/1980 | Wessel et al. | 123/340 |
| 4,329,951 | 5/1982 | Seilly | 123/179 L |
| 4,357,920 | 11/1982 | Stumpp et al. | 123/358 |

*Primary Examiner*—Magdalen Y. C. Moy

*Attorney, Agent, or Firm*—Edwin E. Greigg

[57] ABSTRACT

An electronic control device is proposed for a Diesel fuel metering system, in which at the onset of the starting procedure, a constant fuel quantity is pre-specified at first, and this quantity subsequently increases in steps or in a ramp-like manner. Above a predetermined rpm or starting quantity, an rpm-dependent reduction in quantity takes place, to 90% of the full-load quantity. The open-loop or closed-loop control of the starting quantity ends upon the attainment of a speed of 800 rpm, for example. Both an analog and a computerized realization of the control device are provided, and the control device according to the invention is capable of dispensing with the processing of a temperature signal and can thus dispense with the use of one temperature sensor.

12 Claims, 5 Drawing Figures

ELECTRONIC CONTROL DEVICE FOR A FUEL METERING SYSTEM OF AN INTERNAL COMBUSTION ENGINE WITH SELF-IGNITION

This is a continuation of copending application Ser. No. 415,615 filed Sept. 3, 1982 and now abandoned.

BACKGROUND OF THE INVENTION

The invention is based on an electronic control device and a method for a fuel metering system of an internal combustion engine with self-ignition, as described hereinafter. An electronic Diesel regulator having precontrol of air and fuel quantities is known from German Offenlegungsschrift No. 28 03 750.5. The starting control means of this system processes a starting and rpm signal and also processes the signal of a temperature sensor. Although this known electronic Diesel regulator generally does produce satisfactory results, still problems may arise when starting a warm engine. For instance, if the vehicle has been driven until the tank is emtpy, so that the injection lines are partially empty, then if the engine is restarted while still warm, just after the tank has been filled, only a small temperature-dependent starting quantity is released; yet under some circumstances this may not suffice to assure reliable starting, and such specialized instances, therefore, cannot be reliably controlled.

OBJECT AND SUMMARY OF THE INVENTION

With the electronic control device and method for a fuel metering system having sensors for operating parameters and function transducers for a set-point value of the fuel quantity in accordance with operating parameters, a temperature signal can be dispensed with, thus saving the cost of a temperature sensor. Furthermore, pump tolerances in mass production are balanced out in terms of the starting quantity. Finally, the length of time required for starting when the injection lines are empty and the engine is warm is shortened considerably.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
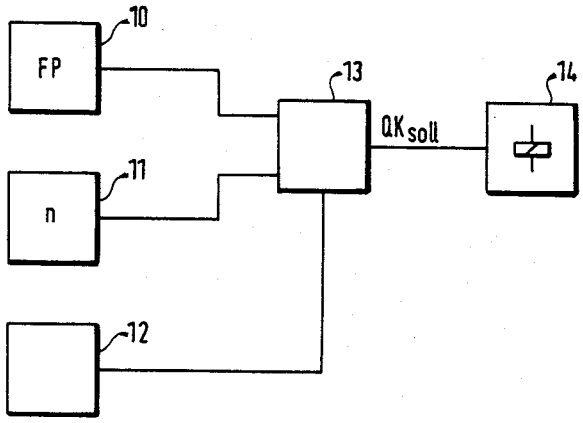
FIG. 1 is an extremely sketchy block circuit diagram of an electronically controllable fuel metering system of an internal combustion engine with self-ignition.

The exemplary embodiments relate to electronic control devices for fuel metering systems in internal combustion engines having self-ignition. In particular, in FIG. 1, sensors are shown for the driving pedal position

10, rpm 11 and a starting switch 12. Their output lines are connected to a signal processing unit 13, at the output of which a fuel quantity set-point signal is made available. This signal controls an electromagnetic final control element 14 for setting the injection quantity, for instance of a Diesel distributor pump.

Figure 2:
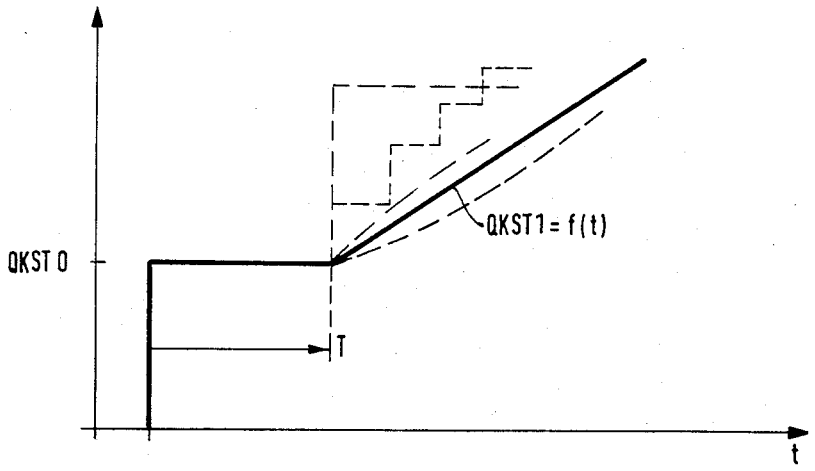
FIG. 2 is a diagram for the fuel quantity during starting, plotted over time.

FIG. 2 shows the starting quantity plotted over time. After the starter has been actuated and when a minimum rpm has been attained, a predetermined fuel quantity QKSTO is released for a period T. This quantity may be the full-load quantity, for example, or 80% of the full-load quantity, and so forth. After the period T, an increase in fuel quantity is effected. A solid line indicates a ramp function, which may be time-dependent and/or rpm-dependent. Dashed lines represent stepped or jump-like increases, as well, that are steady but not linear.

The starting quantity seen in FIG. 2 remains effective up to an rpm threshold, subsequent to which the injection quantity is determined by the driving pedal, the rpm and other variables. During the starting process, however, the driving pedal has no influence on the injection quantity. Nevertheless it is also conceivable to provide that the driving pedal may be able to exert some influence during the starting process only if the fuel quantity pre-specified by the driving pedal is greater than the starting quantity.

In order to avoid excessive bursts of smoke during starting, an rpm-dependent reduction is made in the starting quantity. This reduction becomes effective above a predetermined rpm, by means of a minimum-value selection. An example of the downward rpm control is given in FIG. 3, which shows linear downward control functions, and which in the particular instance at 500 rpm attains a final value of 90% of the full-load quantity. Reducing the fuel quantity over the rpm prevents excessively great bursts of smoke; otherwise, the starting time is shortened if relatively large fuel quantities are injected at low rpm.

Figure 3:
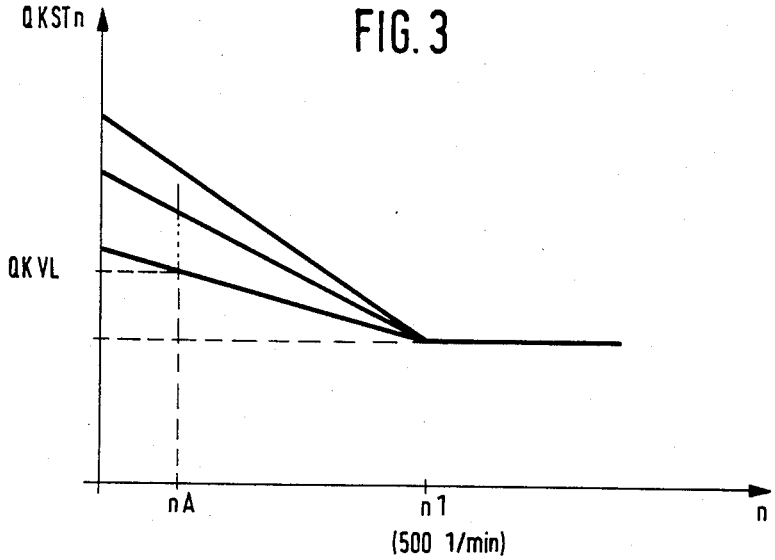
FIG. 3 is a diagram showing characteristic curves for the breakaway downward control of the starting quantity, plotted over time.

A significant feature of the invention is that the two diagrams given in FIGS. 2 and 3 are superimposed on one another. In analog circuitry this is attainable by means of an electronic control unit shown as a block circuit diagram in FIG. 4, which illustrates an exemplary embodiment of the electronic control device according to the invention. A starting signal switch 12 is coupled via a switch 20 with a timing element 21 and a basic-quantity signal generating circuit 22. The output of the timing element 21 is followed by a function generator 23 for furnishing a time-dependent supplementary quantity signal QKST1. The outputs of the two signal generator circuits 22 and 23 are carried to a summing point 24, which is followed by a series circuit comprising a minimum value selection circuit 25, a maximum value selection circuit 26, and, finally, the electromagnetic final control element 14. The output signal of the rpm sensor 11 is connected to the control input of the switch 20 and also to a function generator 28, which at its output side emits the rpm-dependent quantity signal QKSTn and delivers it to the minimum value circuit 25 as the second input signal therefor. Finally, the maximum value circuit 26 also receives a control signal from a function generator 30, which controls the setpoint value of the injection quantity during normal operation.

Figure 4:
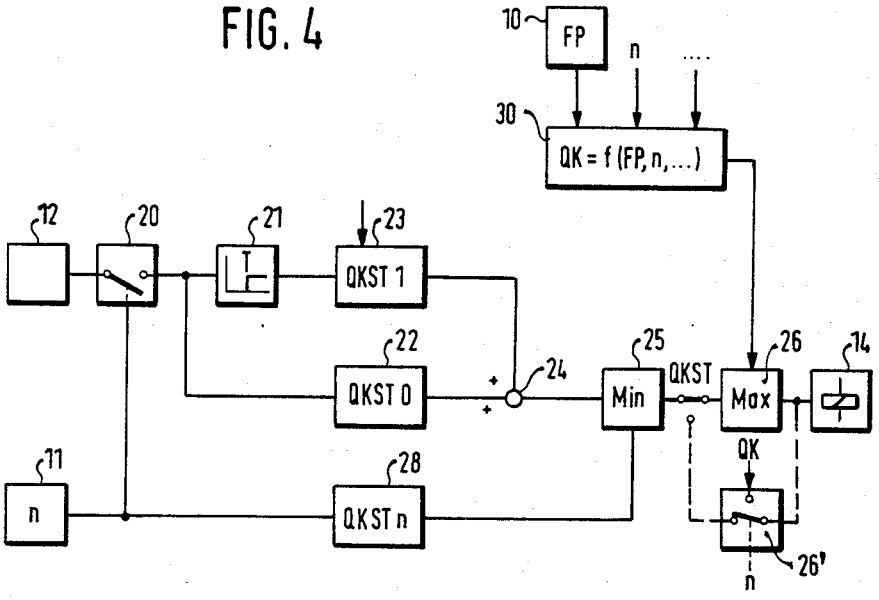
FIG. 4 is a block circuit diagram of the electronic control device according to the invention for a Diesel fuel metering system.

The method of operation of the described circuit layout shown in FIG. 4 is as follows:

If after the actuation of the starting switch the engine attains a minimum rpm, then the basic-quantity signal generator circuit 22 determines the injection quantity value at first. Superimposed thereon, after a period T of FIG. 2 has elapsed, is a supplementary signal from the function generator 23, shown in FIG. 2 in purely time-dependent form, so that the output signal of the summing point 24 takes the signal course shown in FIG. 2. Since the engine is operating, the function generator 28 for the rpm-dependent control of the fuel metering simultaneously comes into play, and in the final analysis it is the minimum value selection circuit 25 that determines which of the two signals, of FIG. 2 or FIG. 3, is supplied as the fuel quantity control value QKST. In the maximum value selection circuit 26 which follows, it is decided in turn whether the starting control signal will predominate, or the signal from the function generator 30 for normal operation will predominate.

An alternating switch 26' is shown in FIG. 4 as a separate element; depending upon the desired form of embodiment, it may replace the maximum value selection circuit 26. The alternating switch 26' is controlled by means of an rpm-dependent signal, in which case the transition from starting control to normal control is purely rpm-dependent.

Figure 5:
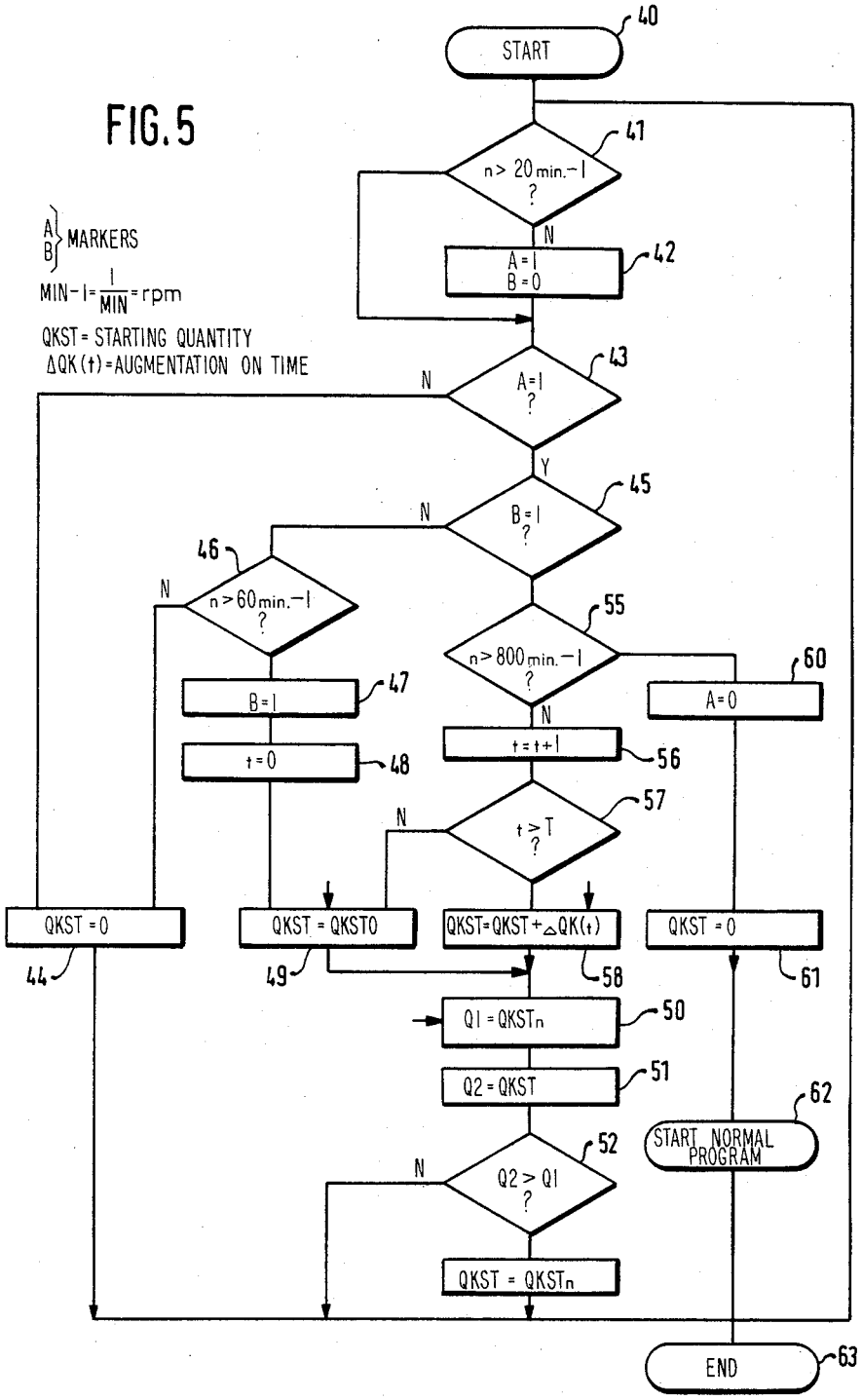
FIG. 5 is a flow diagram explaining the invention in the case of computerized realization.

FIG. 5 provides a flow diagram from the computer-controlled simulation of the above-described functional courses.

In the flow diagram of FIG. 5, the starting program begins in block 40. An interrogation as to the existence of a speed value of 20 rpm follows (41). So long as this rpm value has not yet been attained, then one marker A=1 and one marker B=1 are set (42). An interrogation of the marker A as to the value 1 then takes place (43). As long as the marker has not been set to 1, no fuel is measured at block 44, and the interrogation starts again at the beginning. If the marker A has the value 1, then the interrogation of the value of marker B takes place. In the starting case, that is, below 20 rpm, the marker B has the value 0, so that in that starting instance, a "no" signal appears at the marker B interrogation block 45. A further rpm interrogation block 46 follows, the threshold value of which is 60 rpm. As long as this rpm value has not yet been attained, block 44 again comes into play, and accordingly no fuel metering occurs. However, if the 60-rpm threshold has been attained, then the marker B is set to 1 (47), and a time counter 48 is set to zero. At the same time, the metering of fuel is activated, with an initial value QKST=QKSTO (49). This corresponds to the fuel quantity jump of FIG. 2. Following this fuel quantity determination 49, the rpm dependency of the fuel metering is computed in a special program step 50, and in the next program step 51 a starting quantity having the value QKST of block 49 is defined. An interrogation 52 then follows as to whether the starting quantity value is more or less than the instantaneous rpm-dependent quantity value QKSTn. So long as this value has not yet been attained, another return to the program is made. If the starting quantity has attained the rpm-dependent value, however, then the rpm dependency predominates, and the given starting quantity is supplied with this value. Since the marker B=1 is set in block 47, the second or "yes" output comes into play in the interrogation unit 45 when the program is run again. An rpm interrogation then takes place as to the value of 800 rpm in block 55. As long as this value has not yet been attained, a time counting process begins and continues in block 56, and finally a time interrogation takes place as to the period T, in block 57. For times shorter than T, the basic starting quantity QSTO (block 49) is metered in accordance with FIG. 2. In the other case, each time the program is run an integration procedure takes place with a predetermined augmentation (block 58). Above a speed of 800 rpm (interrogation unit 44), the marker A=0 is set (60), the starting quantity is likewise set to zero (61) and the normal program for fuel metering during normal operation is then selected (62). Finally, 63 indicates the end of the complete program.

In detail, the flow diagram illustrates the following course of the program. For safety reasons, a starting procedure is defined as such only above a speed of 20 rpm. Fuel is not metered until a threshold of 60 rpm has been passed. A period T of constant fuel metering then elapses, and next a period of fuel metering with an upwardly sloping function, the slope depending on the type of augmentation (see block 58). This increase lasts until such time as the rpm-dependent quantity curve QKSTn of FIG. 3 has been attained. If it has been attained, then the rpm-dependent downward control predominates, so that the metered fuel quantity likewise does not continuously increase, but instead is reduced according to the curve of FIG. 3. Above a speed of 800 rpm, the starting procedure is considered terminated, and the normal program begins.

In the flow diagram of FIG. 5, the output values of blocks 49, 50 and 58 may be variable in order to be able to establish basic fuel quantity values, rpm-dependent fuel quantity values and augmentation rates. Naturally the point at which the program is rerun can be selected differently from what is shown in FIG. 5.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A method for determining a fuel quantity control signal in a fuel metering system of an internal combustion engine with self-ignition, having sensors for operating parameters and function transducers for a set-point value of the fuel quantity in accordance with operating parameters, comprising the steps of, pre-specifying at least one of a time-dependent starting fuel quantity and an rpm-dependent starting fuel quantity as the fuel quantity control signal during starting below a predetermined rpm value, selecting the set-point value of the fuel quantity as the fuel quantity control signal during starting above a predetermined rpm value that is below idle speed, and reducing the set-point value of the fuel quantity at least in accordance with rpm.

2. A method for determining a fuel quantity control signal in a fuel metering system of an internal combustion engine with self-ignition, having sensors for operating parameters and function transducers for a set-point value of the fuel quantity in accordance with operating parameters, comprising the steps of, pre-specifying at least one of a time-dependent starting fuel quantity and an rpm-dependent starting fuel quantity as the fuel quantity control signal during starting below a predetermined fuel quantity value, selecting the set-point value of the fuel quantity as the fuel quantity control signal during starting above a predetermined fuel quantity value that is above idle fuel quantity, and reducing the set-point value of the fuel quantity at least in accordance with rpm.

3. A method as defined by claim 1, wherein the time-dependent function for said starting fuel quantity has a constant value at the outset and then increases in a ramp-like manner.

4. A method as defined by claim 1, wherein the time-dependent function for said starting fuel quantity has a constant value at the outset and then increases in a stepped, non-linear manner.

5. A method as defined by claim 1, wherein the set-point fuel quantity decreases with increasing rpm.

6. A method as defined by claim 1, further comprising the steps of, beginning the supply of fuel above a speed of preferably 60 rpm, and determining the fuel metering independent of the starting quantity signal generation above a speed of preferably 800 rpm.

7. An electronic control device for a fuel metering system of an internal combustion engine with self ignition, having sensors for operating parameters and function transducers for generating a set-point value of the fuel quantity in accordance with operating parameters, comprising, means responsive to a starter signal switch for generating at least one of a time-dependent starting quantity signal, and an rpm-dependent quantity signal below a predetermined value as a fuel quantity control signal, and selection means responsive to both said quantity signals for selecting said set-point value of the fuel quantity during starting above a predetermined value, as said fuel quantity control signal to said engine.

8. An electronic control device according to claim 7, wherein said selection means comprises a minimum value selection circuit and a maximum value selection circuit, and a function generator connected to said maximum value selection circuit for generating a reference signal thereto, whereby said maximum value circuit is responsive to said fuel quantity control signal and said reference signal for controlling said set-point value.

9. A method as defined by claim 2, wherein the time-dependent function for said starting fuel quantity has a constant value at the outset and then increases in a ramp-like manner.

10. A method as defined by claim 2, wherein the time-dependent function for said starting fuel quantity has a constant value at the outset and then increases in a stepped, non-linear manner.

11. A method as defined by claim 2, wherein the set-point fuel quantity decreases with increasing rpm.

12. A method as defined by claim 2, further comprising the steps of, beginning the supply of fuel above a speed of preferably 60 rpm, and determing the fuel metering independent of the starting quantity signal generation above a speed of preferably 800 rpm.

* * * * *